US007318319B2

(12) United States Patent
Hubbard et al.

(10) Patent No.: US 7,318,319 B2
(45) **Date of Patent: *Jan. 15, 2008**

(54) APPARATUS FOR CRYOGENIC FLUIDS HAVING FLOATING LIQUEFACTION UNIT AND FLOATING REGASIFICATION UNIT CONNECTED BY SHUTTLE VESSEL, AND CRYOGENIC FLUID METHODS

(75) Inventors: Bradford S. Hubbard, Katy, TX (US); Ned P. Baudat, New Branfels, TX (US); W. Scott Worthington, Brookshire, TX (US)

(73) Assignee: Wood Group Advanced Parts Manufacture, Neunhof (CH)

( * ) Notice: Subject to any disclaimer, the term of this patent is extended or adjusted under 35 U.S.C. 154(b) by 59 days.

This patent is subject to a terminal disclaimer.

(21) Appl. No.: 10/971,767

(22) Filed: Oct. 21, 2004

(65) Prior Publication Data

US 2006/0010911 A1 Jan. 19, 2006

Related U.S. Application Data

(63) Continuation-in-part of application No. 10/894,355, filed on Jul. 18, 2004.

(51) Int. Cl.
*F17C 9/02* (2006.01)
*F17C 13/08* (2006.01)
*B65B 3/00* (2006.01)

(52) U.S. Cl. ..... 62/50.2; 62/53.2; 141/387

(58) Field of Classification Search ..... 62/611, 62/50.2, 53.2; 141/387, 388, 82
See application file for complete search history.

(56) References Cited

U.S. PATENT DOCUMENTS

| | | | | |
|---|---|---|---|---|
| 4,202,648 | A * | 5/1980 | Kvamsdal | 405/210 |
| 4,217,848 | A * | 8/1980 | Meyer-Haake | 114/264 |
| 6,089,022 | A * | 7/2000 | Zednik et al. | 60/641.7 |
| 6,637,479 | B1 * | 10/2003 | Eide et al. | 141/387 |

* cited by examiner

*Primary Examiner*—Cheryl Tyler
*Assistant Examiner*—Michael J. Early
(74) *Attorney, Agent, or Firm*—Gilbreth & Assocaites PC; J. M. (Mark) Gilbrath; Mary A. Gilbrath

(57) ABSTRACT

Methods and systems for transportation of a cryogenic fluid. The system includes a floating liquefaction unit receiving a gas from a source, a shuttle vessel for carrying liquefied gas away from the liquefaction unit, and a floating regasification unit for receiving the liquefied gas from the vessel, regassifying the liquefied gas and providing the gas to a distribution system.

5 Claims, 3 Drawing Sheets

APPARATUS FOR CRYOGENIC FLUIDS HAVING FLOATING LIQUEFACTION UNIT AND FLOATING REGASIFICATION UNIT CONNECTED BY SHUTTLE VESSEL, AND CRYOGENIC FLUID METHODS

RELATED APPLICATION DATA

This application is a continuation-in-part (CIP) of U.S. patent application Ser. No. 10/894,355, filed Jul. 18, 2004, the disclosure of which is herein incorporated by reference.

BACKGROUND OF THE INVENTION

1. Field of the Invention

The present invention relates to cryogenic fluids. In another aspect, the present invention relates to methods and apparatus for processing, transporting and/or storing cryogenic fluids. In even another aspect, the present invention relates to receiving and/or dispensing terminals for cryogenic fluids and to methods of receiving, dispensing and/or storing cryogenic fluids. In still another aspect, the present invention relates a cryogenic fluid system having a floating liquefaction unit receiving a gas from a source, a shuttle vessel for carrying liquefied gas away from the liquefaction unit, and a floating regasification unit for receiving the liquefied gas from the vessel, regassifying the liquefied gas and providing the gas to a distribution system.

2. Description of the Related Art

Most conveniently, natural gas is transported from the location where it is produced to the location where it is consumed by a pipeline. However, given certain barriers of geography, economics, and/or politics, transportation by pipeline is not always possible, economic or permitted. Without an effective way to transport the natural gas to a location where there is a commercial demand, the gas may be burned as it is produced, which is wasteful or reinjected into a subsurface reservoir which is costly and defers the utilization of the gas.

Liquefaction of the natural gas facilitates storage and transportation of the natural gas (a mixture of hydrocarbons, typically 65 to 99 percent methane, with smaller amounts of ethane, propane and butane). When natural gas is chilled to below its boiling point (in the neighborhood of −260° F. depending upon the composition) it becomes an odorless, colorless liquid having a volume which is less than one six hundredth (1/600) of its volume at ambient atmospheric surface temperature and pressure. Thus, it will be appreciated that a 50,000 cubic meter LNG tanker ship is capable of carrying the equivalent of 1.1 billion cubic feet of natural gas.

When LNG is warmed above its boiling point, it boils reverting back to its gaseous form.

The growing demand for natural gas has stimulated the transportation of LNG by special tanker ships. Natural gas produced in remote locations, such as Algeria, Malaysia, Brunei, or Indonesia, may be liquefied and shipped overseas in this manner to Europe, Japan, United States, or neighboring countries needing gas. Typically, the natural gas is gathered through one or more pipelines to a land-based liquefaction facility. The LNG is then loaded onto a tanker equipped with cryogenic compartments (such a tanker may be referred to as an LNG carrier or "LNGC") by pumping it through a relatively short pipeline. After the LNGC reaches the destination port, the LNG is offloaded by cryogenic pump to a land-based regasification facility, where it may be stored in a liquid state or regasified. If regasified, the resulting natural gas then may be distributed through a pipeline system to various locations where it is consumed.

Of the known liquid energy gases, liquid natural gas is the most difficult to handle because it is so intensely cold. Complex handling, shipping and storage apparatus and procedures are required to prevent unwanted thermal rise in the LNG with resultant regassification. Storage vessels, whether part of LNG tanker ships or land-based, are closely analogous to giant thermos bottles with outer walls, inner walls and effective types and amounts of insulation in between.

A number of patents disclose transportation of cryogenic fluids.

U.S. Pat. No. 3,830,180, issued Aug. 20, 1974 to Bolton, discloses a ship for the transportation of volatile liquids having holds which contain a number of elongated vessels for containing cargo fluids where each vessel has a primary barrier for isolating cargo fluids from the hull and an insulating wall.

U.S. Pat. No. 4,317,474, issued Mar. 2, 1982 to Kentosh, describes a mooring and cargo transfer terminal for use in transferring a fluid such as LNG (liquified natural gas) which is supercooled and therefore likely to cause severe icing of pipes and joints. The terminal includes a table support in the form of a tower extending from a base at the sea floor up to the sea surface, and a table device rotatable about a vertical axis at the top of the table support. The table device carries a pair of fenders that can press directly against the side of a ship, hawser couplings for tying the table device to a set of hawsers that hold it tightly against the ship, and one or more loading arms which can extend beyond the table device to connect to an LNG coupling on the ship. A pipe carries LNG from an underwater pipeline up to a fluid swivel at the top of the table support, and the rotatable portion of the fluid swivel connects to the loading arms to deliver the LNG thereto. The direct abutment of the rotatable table with the side of a ship near the bow thereof, enables loading arms of minimal length to be utilized to carry the LNG to the ship.

U.S. Pat. No. 4,202,648, issued May 13, 1980 to Kvamsdal, discloses a floating plant for offshore liquefaction, temporary storage and loading of LNG, made as a semi-submersible platform with storage tanks for LNG arranged in the submerged section of the platform. The storage tanks are independent spherical tanks which are supported inside the submerged section of the platform and completely surrounded thereby.

U.S. Pat. No. 6,085,528, issued Jun. 11, 2000, Woodall et al, discloses an improved system for processing, storing, and transporting LNG, and describes containers and transportation vessels for storage and marine transportation of pressurized liquefied natural gas (PLNG) at a pressure in the broad range of about 1035 kPa (150 psia) to about 7590 kPa (1100 psia) and at a temperature in the broad range of about −123.degree. C. (−190.degree. F.) to about −62.degree. C. (−80.degree. F.). Containers described in the PLNG Patent are constructed from ultra-high strength, low alloy steels containing less than 9 wt % nickel and having tensile strengths greater than 830 MPa (120 ksi) and adequate toughness for containing PLNG.

U.S. Pat. No. 6,460,721, issued Oct. 8, 2002 to Bowen et al., discloses systems and methods for producing and storing pressurized liquefied natural gas (PLNG), wherein the systems and methods include (a) a natural gas processing plant suitable for producing PLNG; and (b) at least one container suitable for storing the PLNG, the at least one container comprising (i) a load-bearing vessel made from a composite material and (ii) a substantially non-load-bearing liner in contact with the vessel, said liner providing a substantially impermeable barrier to the PLNG. The systems and methods also preferably include (c) means for transporting the at least one container containing PLNG to an import terminal.

U.S. Pat. No. 6,560,988, issued May 13, 2003 to Kimble, describes systems and methods for delivering pressurized liquefied natural gas to an import terminal equipped with containers and vaporization facilities suitable for conventional LNG. The pressurized liquefied natural gas cargo, or any fraction thereof, is converted into conventional liquefied natural gas and sent to storage tanks suitable for conventional liquefied natural gas. Any of the cargo not converted to conventional liquefied natural gas can be compressed and warmed to pipeline specifications. This gas can then pass into a sendout pipeline.

U.S. Pat. No. 6,637,479, issued Oct. 28, 2003 to Eide, et al., discloses a system for offshore transfer of liquefied natural gas between two vessels. The system comprises a coupling head mounted at one end of a flexible pipe means and arranged for attachment on a platform at one end of one vessel when it is not in use, and a connection unit mounted at one end of the other vessel and comprising a pull-in funnel shaped for guided pull-in of the coupling head to a locking position in which the pipe means can be connected to transfer pipes on the other vessel via a valve means arranged in the coupling head. The coupling head is provided with a guide means and is connected to at least one pull-in wire for guided pull-in of the coupling head into the connection unit by a winch means an the other vessel.

All of the patents cited in this specification, are herein incorporated by reference.

However, in spite of the above advancements, there still exists a need in the art for apparatus and methods for processing, transporting, and/or storing LNG.

This and other needs in the art will become apparent to those of skill in the art upon review of this specification, including its drawings and claims.

SUMMARY OF THE INVENTION

It is an object of the present invention to provide for improved apparatus and methods for processing, transporting, and/or storing LNG.

This and other objects of the present invention will become apparent to those of skill in the art upon review of this specification, including its drawings and claims.

According to one embodiment of the present invention, there is provided an apparatus for transporting a gas. The apparatus includes a floating liquifaction unit having a first docking system. The apparatus also includes a floating regassification unit having a second docking system. The apparatus also includes a shuttle vessel comprising a third docking system. The shuttle vessel may be docked with the liquifaction unit, docked with the gassification unit, or traveling between the liquifaction unit and the regassification unit. The third docking system is connectable with the first docking system when the vessel is docked with the liquifaction unit, and connectable with the second docking system when the vessel is docked with the gassification unit. As further embodiments of this embodiment, the floating liquifaction unit may be connected to a gas source, and the floating regassification unit is connected to a gas distribution system. As even further embodiments, the liquifacation unit, the gassification unit, and the vessel are all floating on a body of water. As still further embodiments, there are provided methods of operating such an apparatus, and methods of transporting a gas.

According to another embodiment of the present invention, there is provided a method of transporting a gas. The method includes receiving the gas into a floating liquifaction unit. The method further includes liquifying the gas to form a liquified gas. The method further includes transfering the liquified gas from the liquifaction unit into a marine vessel. The method further includes transfering the liquified gas from the marine vessel into a floating regassification unit. The method further includes regassifying the liquified gas into a regassified gas. The method may also include providing the regassified gas to a distribution system.

According to even another embodiment of the present invention, there is provided a floating liquifaction unit, methods of operating such a unit, and methods of liquifacation.

According to still another embodiment of the present invention, there is provided a floating regassification unit, methods of operating such a unit, and methods of regassification.

These and other embodiments of the present invention will become apparent to those of skill in the art upon review of this specification, including its drawings and claims.

BRIEF DESCRIPTION OF THE DRAWINGS

In the drawings, it should be understood that like reference numbers refer to like members.

DETAILED DESCRIPTION OF THE INVENTION

While some descriptions of the present invention may make reference to natural gas and to liquified natural gas ("LNG"), it should be understood that the present invention is not limited to utility with natural gas and LNG, but rather has broad utility with gases and cryogenic fluids in general, preferably cryogenic fluids formed from flammable gases.

The apparatus of the present invention will find utility for processing, storing, and/or transporting (i.e., including but not limited to, receiving, dispensing, distributing, moving) gases and cryogenic fluids, a non-limiting example of which are natural gas and liquified natural gas ("LNG").

According to the present invention, there are provided a floating liquefaction unit, a floating regasification unit, a shuttle vessel traveling therebetween.

Further according to the present invention, there is provided a system comprising a floating liquefaction unit receiving a gas from a source, a shuttle vessel for carrying liquefied gas away from the liquefaction unit, and a floating regasification unit for receiving the liquefied gas from the vessel, regassifying the liquefied gas and providing the gas to a distribution system.

Figure 1:
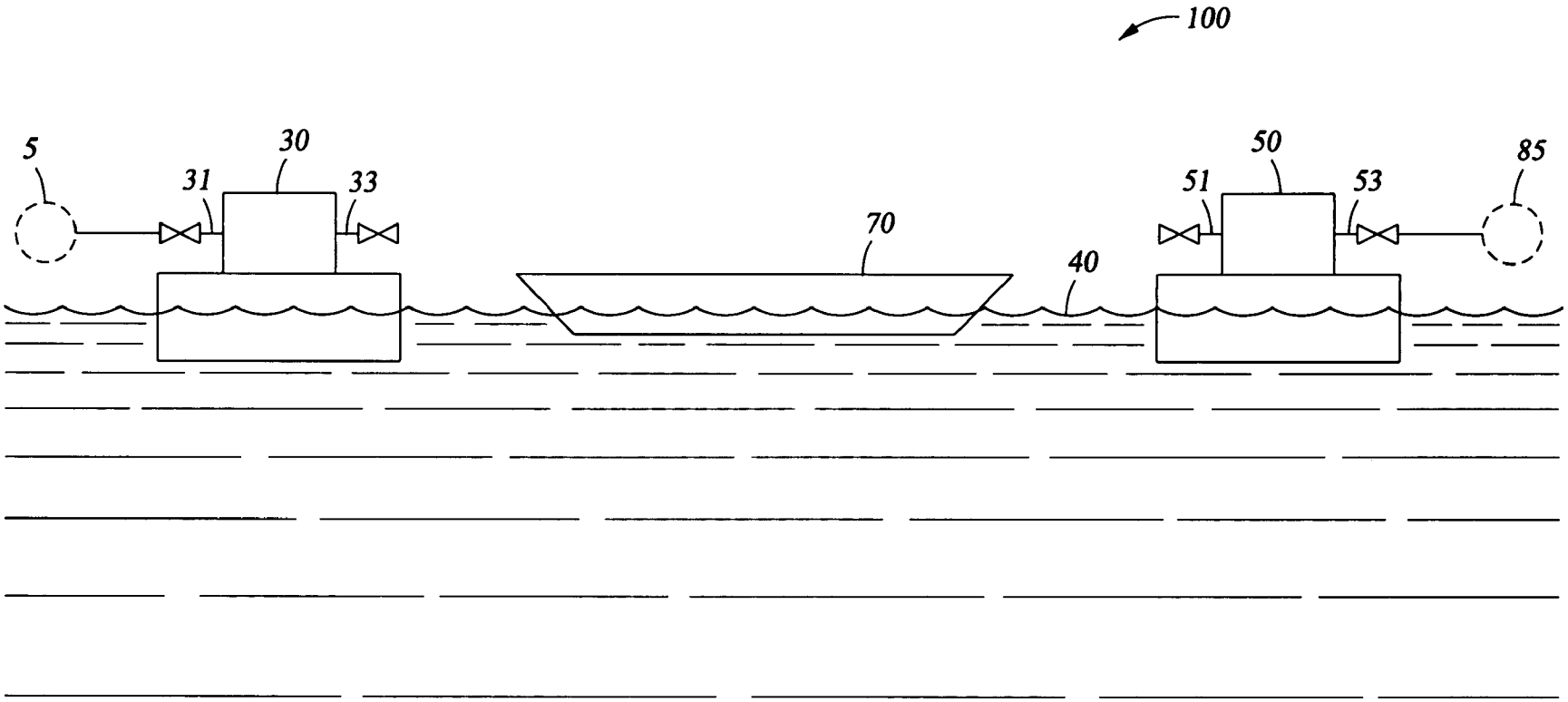
FIG. 1 is a schematic representation of natural gas transportation system 100, showing floating liquefaction unit 30, floating regasification unit 50, and shuttle vessel 70 traveling therebetween.

Referring now to FIG. 1, there is shown a schematic representation of natural gas transportation system 100, showing floating liquefaction unit 30, floating regasification unit 50, and shuttle vessel 70 traveling therebetween.

Floating liquefaction unit 30 is positioned on a body of water 40 and may be permanently or periodically connected via connection 31 to a source of natural gas 5. This source of natural gas 5 may be a direct pipeline connection to natural gas being produced from a well (s), mobile a mobile vessel(s), or to storage tanks. Periodic connections could also be made to land or marine transport vessels carrying storage tanks of natural gas.

Natural gas liquefaction units are well known in the art. In the present invention, floating liquefaction unit 30 will generally include all of the necessary components of a natural gas liquefaction unit as are know to those of skill in the art. Optionally, floating liquefaction unit 30 may include storage tanks for the incoming natural gas. As for storage tanks for the LNG, they may be provided, or optionally, LNG may be produced while shuttle vessel 70 is connect via connection 33 and pumped directly into shuttle vessel 70 without the need to store LNG on floating liquefaction unit 30.

Shuttle vessels for transporting LNG are well known in the art, and any of the known vessels may be utilized in the preset invention as shuttle vessel 70.

LNG regasification units are well known in the art. In the present invention, floating regasification unit 50 will generally include all of the necessary components of a regasification unit as are know to those of skill in the art. Floating regasification unit 50 may include storage tanks for receiving the LNG, or shuttle vessel 70 may serve as a storage tank by remaining docked with floating regasification unit 50 during the regasification process. Floating regasification unit 50 may also include storage tanks for the regasified natural gas, this gas may be provided to off-unit storage into mobile vessels during regasification. Connection 53 may be connected to a distribution system 85, which may be a pipeline system, storage tanks or mobile vessels.

Figure 2:
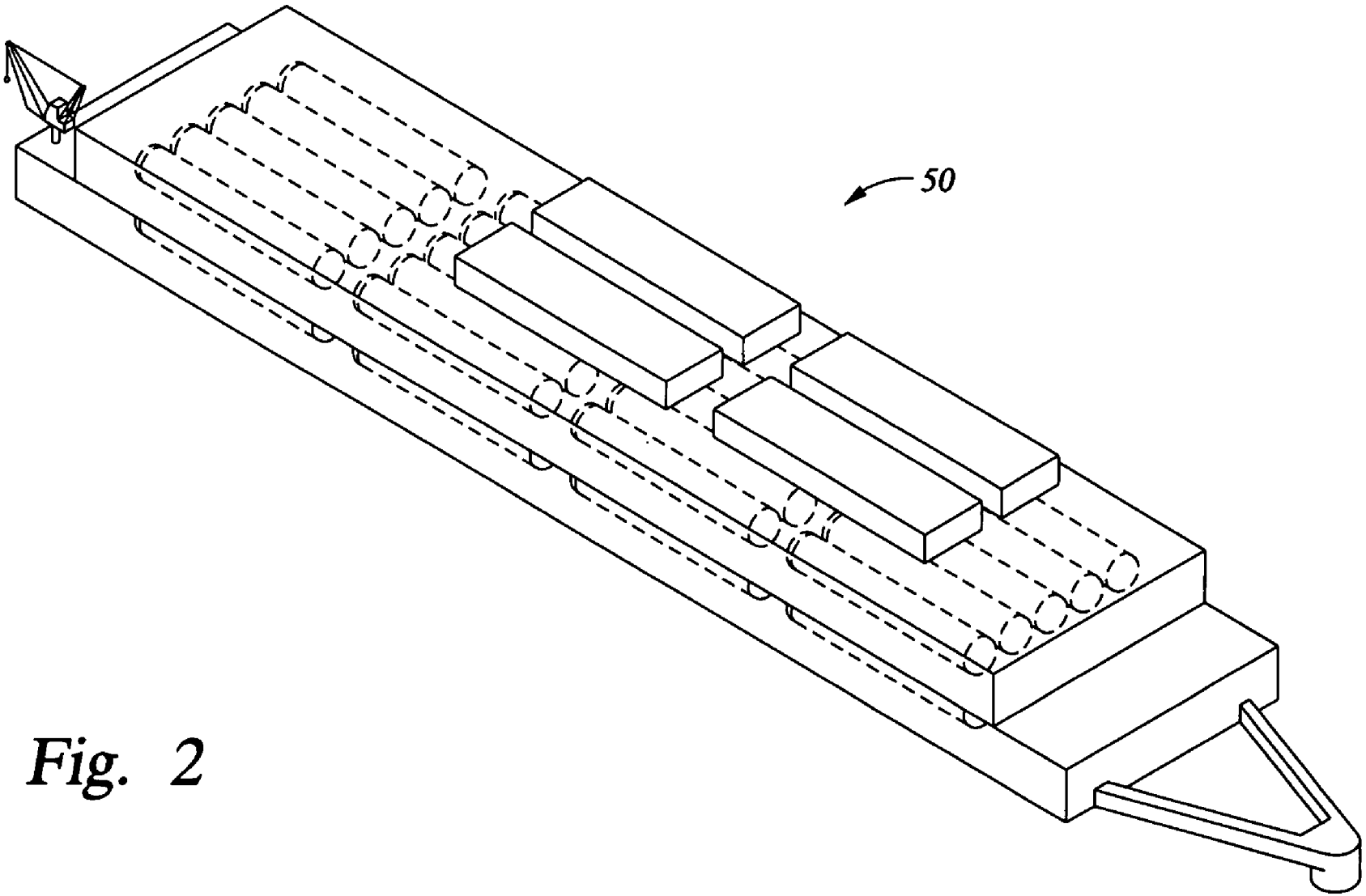
FIG. 2 is a drawing of a non-limiting embodiment of floating regassification unit 50 (also referred to sometimes as "FSRU", i.e., "Floating, Storage and Regassification Unit").

Referring now to FIG. 2, there is shown a specific non-limiting embodiment of floating regassification unit 50 (also referred to sometimes as "FSRU", i.e., "Floating, Storage and Regassification Unit"). According to the present invention, such an FSRU 50 will be a commercially competitive option to GBS (gravity base structure) LNG import terminals.

It should be understood that the following details merely describe one possible non-limiting embodiment of FSRU 50, and that the present invention is not meant to be limited to any of the following specifics.

In the practice of the present invention, the hull of FSRU 50 may be constructed according to acceptable marine engineering principles, and may comprise any suitable material. In the embodiment as shown, the hull will preferably comprise concrete.

Is should be understood that the hull of FSRU 50 may comprise any dimension as desired that may be constructed. In the embodiment as show, the hull is approximately 813 ft long, 181 ft wide, and 110 ft tall.

Storage capacity of FSRU 50 will be of course limited by and a function of the size of the hull. In the embodiment shown in FIG. 2, LNG storage of approximately 160,000 $m^3$ capacity is obtained utilizing on the order of 32 horizontal tanks of 9% nickel steel, of 38 ft diameter and 176 ft long.

These tanks should each be in a concrete compartment surrounded by perlite, and preferably utilize technology as disclosed and described in U.S. patent application Ser. No. 10/782,736, filed Feb. 19, 2004, the disclosure of which is incorporated by reference.

It should be understood that FSRU 50 will comprise marine systems and utilities as legally and/or technically necessary to operate as a stationary offshore floating vessel, and any others as may be optionally desired.

FSRU 50 may also include mooring and berthing equipment and systems as are known in the art. For example, FSRU 50 may comprise equipment for side by side and/or tandem mooring and berthing of LNG transport ships and lightering barges.

This non-limiting embodiment of FSRU 50 will have a send out rate of approximately 800 mmscfd to 1 billion scfd. The LNG vaporization process/equipment utilized may be any as are known in the art, including as a non-limiting example, open rack vaporizers, and/or as described in the below referenced "Baudat Applications."

This non-limiting embodiment FSRU 50 may preferaby comprise complete self contained utilities, including electric power, potable water, and fire protection.

FSRU 50 may also comprise crew quarters, helideck, vent/flare system, boat landing, lifeboats, and any other equipment as may be desired and/or required.

Field architecture for this embodiment of FSRU 50 may be as follows, location near an existing pipeline infrastructure, in water depths of 100 ft to 300 ft, accommodation for 1 or more additional FSRU facilities, mooring ability, an off-take pipeline, and/or LNG tanker and/or lightering barge approaches.

This non-limiting FSRU 50 may utilize any type of LNG transfer system. Non-limiting examples include a cryogenic hose based system utilizing side by side loading and tandem loading, or a system utilizing an intermediate mooring barge for tandem loading, and/or a submerged pipe and hose system for tandem loading.

Non-limiting FSRU 50 may utilize any type of mooring system/equipment. Preferably, FSRU 50 will utilize single point mooring to allow the FSRU to essentially weather vane around the risers (gas swivel for ANSI 600, nominal 1100 psig). Approximate water depth will be in the range of about 100 ft to about 300 ft, utilizing drag embedment or suction pile anchors, permanently connected and designed to survive inclement weather to which the situs is subject (i.e., hurricanes, typhoons and the like).

FSRU 50 may comprise LNG tanker facilities suitable for handing 138,000 $m^3$ to 150,000 $m^3$. Such facilities may accommodate side by side berthing for mid-ship offloading and/or tandem berthing for bow offloading and/or mid-ship offloading.

FSRU 50 may comprise lightering barge handling facilities for handing approximately 20,000 $m^3$ capacity, generally utilizing side by side berthing for loading.

Figure 3:
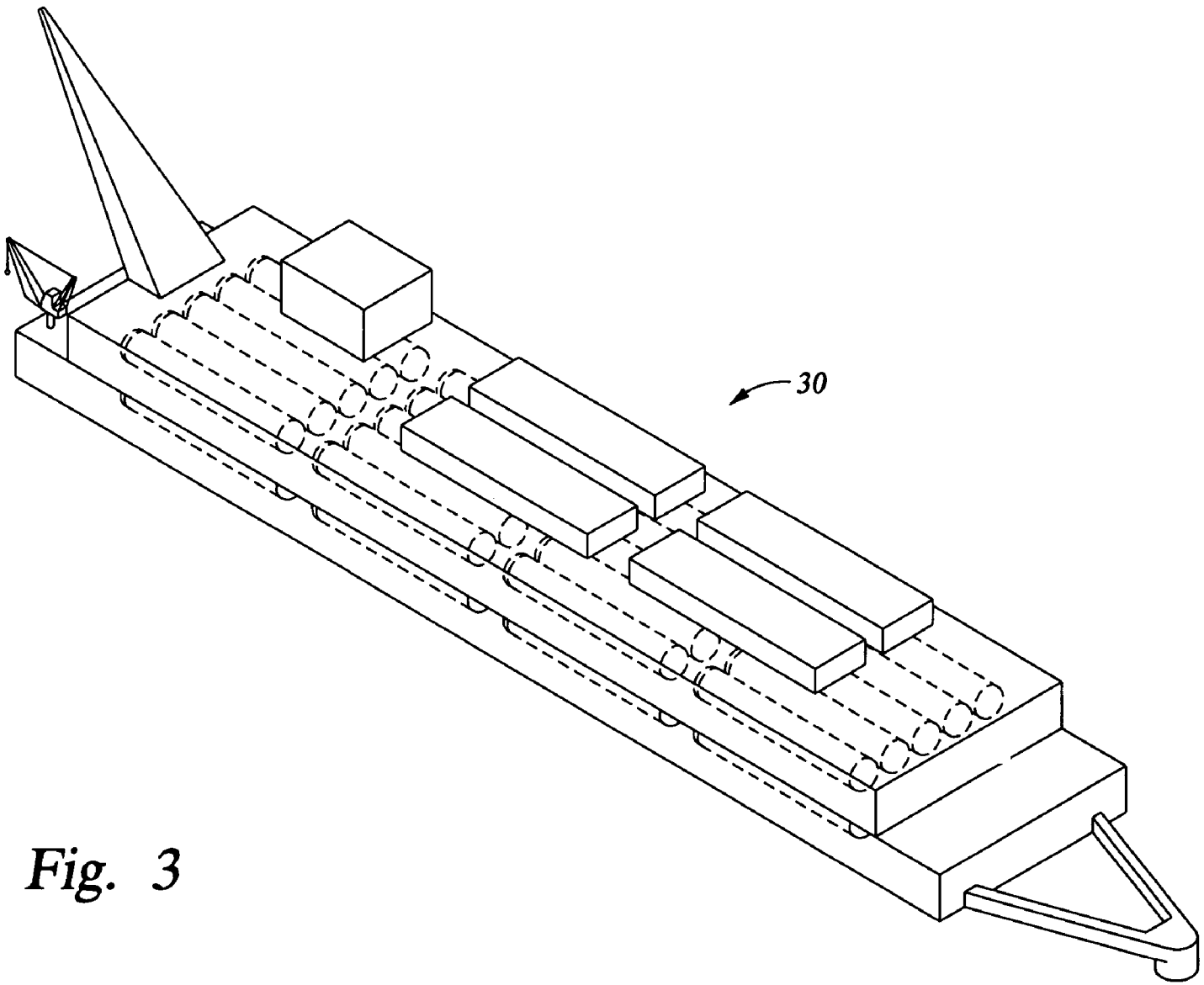
FIG. 3 is a drawing of non-limiting embodiment of floating liquefaction unit 30. (also referred to sometimes as "FPSO", i.e., "Floating, Production, Storage and Offloading vessel").

Referring now to FIG. 3, there is shown a specific non-limiting embodiment of floating liquefaction unit 30. (also referred to sometimes as "FPSO", i.e., "Floating, Production, Storage and Offloading vessel").

It should be understood that the following details merely describe one possible non-limiting embodiment of FPSO 30, and that the present invention is not meant to be limited to any of the following specifics.

In the practice of the present invention, the hull of FPSO 30 may be constructed according to acceptable marine engineering principles, and may comprise any suitable material. In the embodiment as shown, the hull will preferably comprise concrete.

Is should be understood that the hull of FPSO 30 may comprise any dimension as desired that may be constructed. In the embodiment as show, the hull is approximately 813 ft long, 181 ft wide, and 110 ft tall.

Storage capacity of FPSO 30 will be of course limited by and a function of the size of the hull. In the embodiment shown in FIG. 2, LNG storage of approximately 160,000 $m^3$ capacity is obtained utilizing on the order of 32 horizontal tanks of 9% nickel steel, of 38 ft diameter and 176 ft long.

These tanks should each be in a concrete compartment surrounded by perlite, and preferably utilize technology as disclosed and described in U.S. patent application Ser. No. 10/782,736, filed Feb. 19, 2004, the disclosure of which is incorporated by reference.

It should be understood that FPSO 30 will comprise marine systems and utilities as legally and/or technically necessary to operate as a stationary offshore floating vessel, and any others as may be optionally desired.

FPSO 30 may also include mooring and berthing equipment and systems as are known in the art. For example, FPSO 30 may comprise equipment for side by side and/or tandem mooring and berthing of LNG transport ships and lightering barges.

This non-limiting embodiment of FPSO 30 will have an LNG production rate ranging from about 50 to about 500 mmscfd. LNG liquefaction process/equipment utilized may be any as are known in the art, and/or as described in the below referenced "Baudat Applications."

This non-limiting embodiment FPSO 30 may preferaby comprise complete self contained utilities, including electric power, potable water, and fire protection.

FPSO 30 may also comprise crew quarters, helideck, vent/flare system, boat landing, lifeboats, and any other equipment as may be desired and/or required.

Field architecture for this embodiment of FPSO 30 may be as follows, location near a producing field or near an existing pipeline infrastructure, in water depths of 100 ft to 8000 ft, mooring ability, gas supply pipeline, and/or LNG tanker, equipment barge and/or lightering barge approaches.

This non-limiting FPSO 30 may utilize any type of LNG transfer system. Non-limiting examples include a cryogenic hose based system utilizing side by side loading and tandem loading, or a system utilizing an intermediate mooring barge for tandem loading, and/or a submerged pipe and hose system for tandem loading.

Non-limiting FPSO 30 may utilize any type of mooring system/equipment. Preferably, FPSO 30 will utilize single point mooring to allow the FSRU to essentially weather vane around the risers (gas swivel for ANSI 600, nominal 1100 psig). Approximate water depth will be in the range of about 100 ft to about 8000 ft, utilizing drag embedment or suction pile anchors, permanently connected and designed to survive the worse inclement weather to which the situs is subject (i.e., hurricanes, typhoons and the like).

FPSO 30 may comprise LNG tanker facilities suitable for handing 138,000 $m^3$ to 150,000 $m^3$. Such facilities may accommodate side by side berthing for mid-ship offloading and/or tandem berthing for bow offloading and/or mid-ship offloading.

FPSO 30 may comprise lightering barge handling facilities for handing approximately 20,000 $m^3$ capacity, generally utilizing side by side berthing for loading.

In operation of transportation system 100, natural gas 5, whether directly from a well, storage tank or mobile vehicle, is provided via connection 31 to liquefaction unit 30. This natural gas is then liquefied in liquefaction unit 30, where it may or may not be stored first before being pumped via docking connection 33 into shuttle vessel 70. This shuttle vessel 70 then traverses body of water 40 to regasification unit 50. Docking connection 51 facilitates offloading of the LNG to regasification unit 50, either into storage tanks or directly into the regasification process. Once the LNG is regasified, it may be stored on regasification unit 50 or provided via connection 53 to off-unit storage tanks, a distribution pipeline, or to mobile vessels.

The present invention may incorporate any desirable apparatus and method features as described and/or taught in any of U.S. patent application Ser. No. 10/782,736 (filed Feb. 19, 2004), Ser. No. 10/777,506 (filed Feb. 11, 2004), Ser. No. 10/816,793 (filed Apr. 1, 2004), and Ser. No. 10/869,461 (filed Jun. 15, 2004), all by applicant Ned P. Baudat ("Baudat Applications"), the specifications of which are all herein incorporated by reference for all that they disclose and teach.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

We claim:

1. An apparatus for transporting a gas, the apparatus comprising:

a Floating, Production, Storage and Offloading-type floating liquefaction unit comprising a first docking system;

a Floating, Storage and Regasification Unit-type floating regasification unit comprising a second docking system; and, a shuttle vessel comprising at least one liquefied gas storage tank, a third docking system, wherein the shuttle vessel may be docked with the liquefaction unit, docked with the gasification unit, or traveling between the liquefaction unit and the regasification unit, and wherein the third docking system is connectable with the first docking system to allow transfer of a liquefied gas from the liquefaction unit into the vessel gas storage tank when the vessel is docked with the liquefaction unit, and connectable with the second docking system to allow transfer of a liquefied gas from the vessel storage tank to the gasification unit when the vessel is docked with the gasification unit.

2. The apparatus of claim 1, wherein the floating liquefaction unit is connected to a gas source, and the floating regasification unit is connected to a gas distribution system.

3. The apparatus of claim 2, wherein the liquefaction unit, the gasification unit, and the vessel are all floating on a body of water.

4. A method of transporting a gas, comprising;

(A) receiving the gas into a Floating. Production. Storage and Offloading-type floating liquefaction-type floating liquefaction unit, (B) liquefying the gas to form a liquefied gas;

(C) transferring the liquefied gas from the liquefaction unit into a marine vessel;

(D) transferring the liquefied gas from the marine vessel into an a Floating, Storage and Regasification Unit-type floating regasification unit; and (E) regasifying the liquefied gas into a regasified gas.

5. The method of claim 4, wherein the gas of step (A) is from a gas pipeline, a well, mobile vessel, or a storage tank.

* * * * *

US007318319C1

(12) EX PARTE REEXAMINATION CERTIFICATE (8368th)

United States Patent
Hubbard et al.

(10) Number: US 7,318,319 C1
(45) Certificate Issued: Jun. 28, 2011

(54) APPARATUS FOR CRYOGENIC FLUIDS HAVING FLOATING LIQUEFACTION UNIT AND FLOATING REGASIFICATION UNIT CONNECTED BY SHUTTLE VESSEL, AND CRYOGENIC FLUID METHODS

(75) Inventors: Bradford S. Hubbard, Katy, TX (US); Ned P. Baudat, New Branfels, TX (US); W. Scott Worthington, Brookshire, TX (US)

(73) Assignee: Mustang Engineering, L.P., Houston, TX (US)

Reexamination Request:
No. 90/009,379, Jan. 7, 2009

Reexamination Certificate for:

| | |
|---|---|
| Patent No.: | **7,318,319** |
| Issued: | **Jan. 15, 2008** |
| Appl. No.: | **10/971,767** |
| Filed: | **Oct. 21, 2004** |

Related U.S. Application Data

(63) Continuation-in-part of application No. 10/894,355, filed on Jul. 18, 2004, now Pat. No. 7,360,367.

(51) Int. Cl.

| | |
|---|---|
| ***F17C 9/02*** | (2006.01) |
| ***F17C 13/08*** | (2006.01) |
| ***B65B 3/00*** | (2006.01) |

(52) U.S. Cl. ..... 62/50.2; 62/53.2; 141/387
(58) Field of Classification Search ..... 62/50.2
See application file for complete search history.

(56) References Cited

U.S. PATENT DOCUMENTS

| | | | |
|---|---|---|---|
| 1,826,248 A | * | 10/1931 | Heyland |
| 4,202,648 A | | 5/1980 | Kvamsdal |
| 6,434,948 B1 | | 8/2002 | Eide et al. |
| 6,546,739 B2 | | 4/2003 | Frimm et al. |
| 6,598,408 B1 | | 7/2003 | Nierenberg |
| 6,688,114 B2 | | 2/2004 | Nierenberg |
| 6,851,994 B2 | | 2/2005 | Boatman et al. |
| 2002/0073619 A1 | | 6/2002 | Perkins et al. |

OTHER PUBLICATIONS

Dr. Leslie Bottomley, "FLNG Key to Global Energy Supply", Offshore, vol. 62, Issue 10, dated Oct. 1, 2002 (3 pages).

David McDonald, et al., "Comprehensive Evaluations of LNG Transfer Technology for Offshore LNG Development", LNG 14 Conference, Doha, Qatar, Mar. 19–24, 2004 (35 pages).

Hans Y. S. Han, et al., "Design Development of FSRU from LNG Carrier and FPSO Construction Experiences", Offshore Technology Conference, Houston, Texas, May 6–9, 2002 (8 pages).

Kevin Ewans, et al., "Oceanographic and Motion Response Statistics for the Operation of a Weathervaning LNG FPSO", Proceedings of OMAE '03: 22nd International Conference on Offshore Mechanics and Arctic Engineering, Jun. 8–13, 2003, Cancun, Mexico (7 pages).

"Floating LNG Plants Can be Built", MarineTalk Website, http://www.marinetalk.com/articles–marine–companies/art/Floating–LNG–Plants–Can–be–Built–BOU00994501TU.html, Mar. 15, 2001, "Marine Talk" (2 pages).

* cited by examiner

*Primary Examiner*—Robert M. Fetsuga

(57) ABSTRACT

Methods and systems for transportation of a cryogenic fluid. The system includes a floating liquefaction unit receiving a gas from a source, a shuttle vessel for carrying liquefied gas away from the liquefaction unit, and a floating regasification unit for receiving the liquefield gas from the vessel, regassifying the liquefied gas and providing the gas to a distribution system.

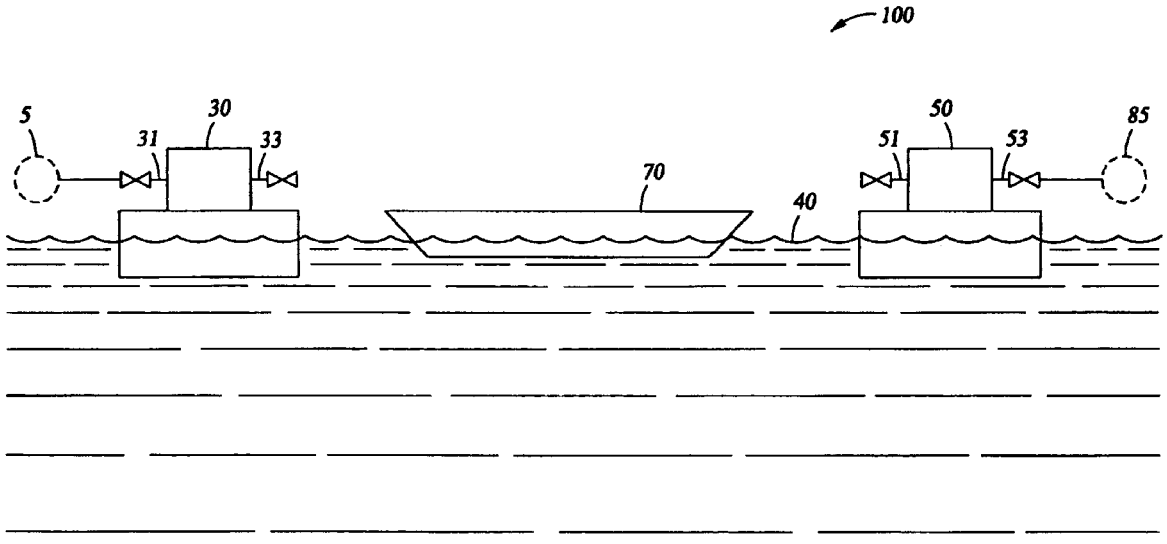

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-5 are cancelled.

* * * * *